United States Patent [19]

Burley

[11] Patent Number: 5,035,416

[45] Date of Patent: Jul. 30, 1991

[54] SLIDING ICE RINK DOOR

[75] Inventor: John S. Burley, Salix, Pa.

[73] Assignee: Burley's Rink Supply, Salix, Pa.

[21] Appl. No.: 519,017

[22] Filed: May 4, 1990

[51] Int. Cl.[5] ..... E04H 17/16; E05F 11/38

[52] U.S. Cl. ..... 272/3; 49/218; 49/254

[58] Field of Search ..... 272/3; 49/212, 218, 49/223, 254, 280

[56] References Cited

U.S. PATENT DOCUMENTS 4,268,996 5/1981 Allen ..... 49/218 X 4,627,134 5/1990 Burley ..... 272/3

4,945,677 8/1990 Krammer ..... 49/254 X

*Primary Examiner*—Richard E. Chilcot, Jr.

*Attorney, Agent, or Firm*—Fidelman & Wolffe

[57] ABSTRACT

A sliding door for an ice rink is disclosed. The door panel member adjacent the door member includes rails upon which the door member can slide once the latch member is unlatched. A hinge mechanism includes two hinges, each having a slider which slides along the rails and a hinge arm hinged between the frame of the door member and the slider. Upon slight lifting of a handle coupled to the latch mechanism to unlatch the door, the door is then free to be pulled in a direction parallel to the door panel member.

9 Claims, 3 Drawing Sheets

SLIDING ICE RINK DOOR

The invention is directed to a rink door for an ice rink and, more particularly, to a sliding ice rink door which is sturdier and safer than previous swinging, hinged doors which fatigue after extended use, due to the wider than normal doors necessary for ice resurfacer egress, or ingress, while sustaining above normal stress from hockey checks.

SUMMARY OF THE INVENTION

Conventional ice rink doors swing outwardly to open. See, for example, U.S. patent application Ser. No. 07/395,361, which is commonly assigned herewith.

Ice rink doors, particularly ice rink doors that permit ingress and egress of ice resurfacing machines, are extremely heavy, especially when an upper protective shield is mounted atop the door structure. Ice rink resurfacing doors are usually used in pairs and are quite large, usually five feet wide, so as to form a 10 foot wide opening through which the ice resurfacing machines can drive. Such ice rink doors can weigh as much as 540 pounds each. Conventional hinged ice rink doors, if permitted to swing free, will sag under this weight. This causes stress on the hinges and, hence, a high fatigue rate, in an abnormal period of time.

To overcome this problem, it is known to use a support wheel mounted on the lower edge of the free end of the door. However, in order for this solution to work, the ice rink must be precisely level with no bumps or build-up of ice to interfere with the travel of the wheel. Most rink surfaces are quite irregular, so that the door cannot swing 88 freely. In response to this, spring-loaded, adjustable wheels have been employed. However, this too has proven to be an unsatisfactory solution.

Another disadvantage of conventional hinged doors is that the hardware mounted on the back side of the door prevents the door from being opened a full 180 degrees. This can obstruct the movement of people past the door opening.

A further disadvantage exists with conventional hinged doors in that many ice skating complexes have aisle space restrictions that prohibit the use of a door requiring a five foot swinging radius.

Moreover, if a conventional hinged door is not latched properly, the door may be inadvertently opened by a force exerted outwardly on the door, such as can be caused by a skater losing control and skating into the door or by leaning on it.

The invention overcomes this potential problem by providing a rink door which is opened by sliding the door along a specially-designed door panel member. The door panel member preferably includes rails along which two hinges coupled to the door member can slide once the door latch member has been released. In this way, the need for a support wheel, and for a perfectly level ice rink surface, is eliminated. The sturdier construction of the ice rink door of the invention enhances the longevity of the door. Because the door member slides substantially flush along the door panel member, there is nothing to obstruct the flow of people through the door opening. Moreover, the space requirements are minimized, since there need not be an allowance left for the swinging radius of the door.

BRIEF DESCRIPTION OF THE DRAWINGS

These and other aspects of the sliding rink door of the invention can be seen from the following drawings, in which.

DETAILED DESCRIPTION OF THE PREFERRED EMBODIMENTS

Figure 1:
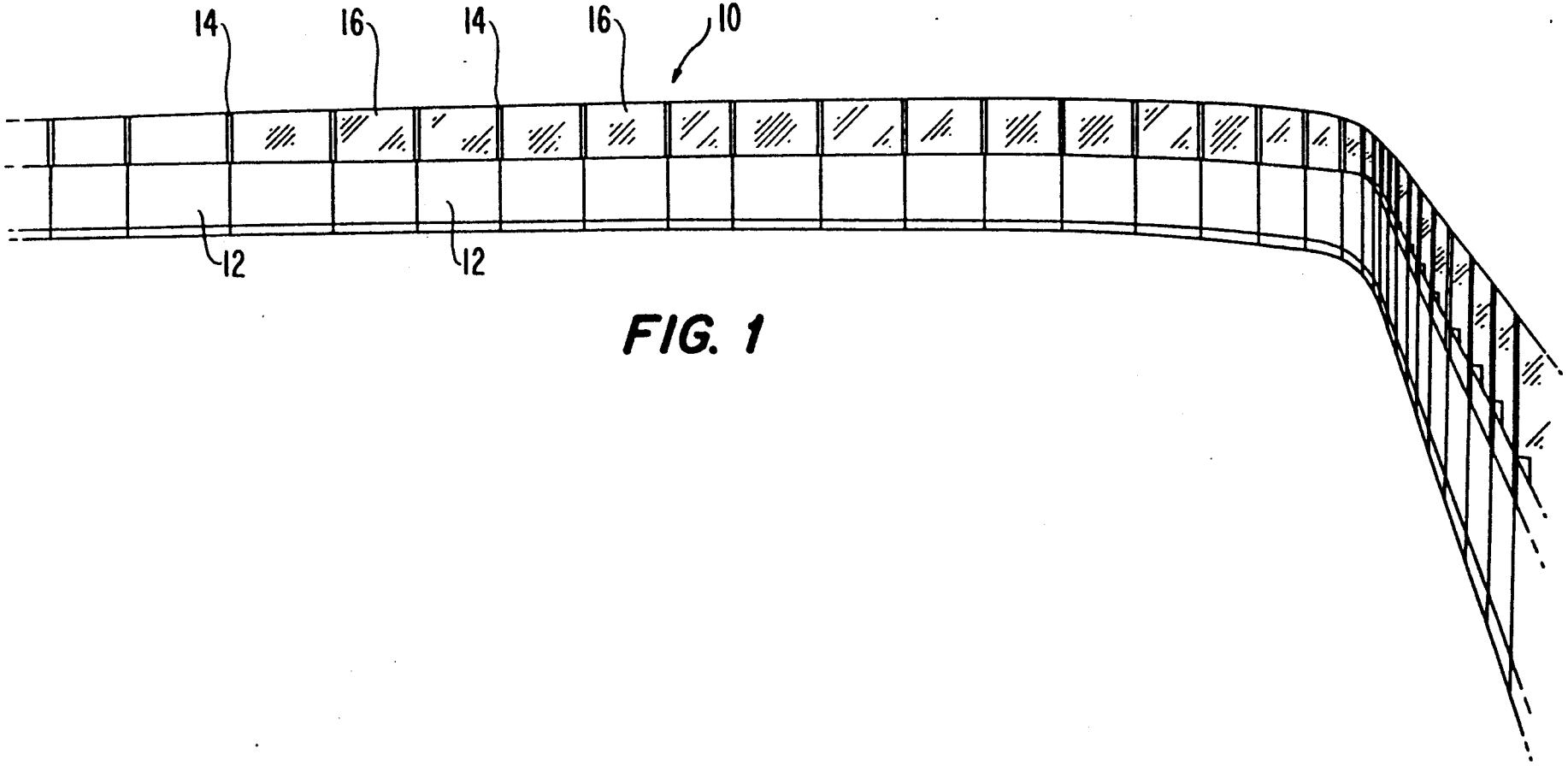
FIG. 1 is an overall perspective view of the ice rink from the interior of the rink (the ice side) having a standard installation of dasher boards.

A standard installation of dasher boards forming an ice skating rink is shown in FIG. 1 and generally designated 10. The rink 10 includes a plurality of dasher board panels 12 anchored by any suitable means (not shown) to the ice rink substrate. A plurality of upright supports 14 extend upwardly to support transparent panels 16.

Figure 2:
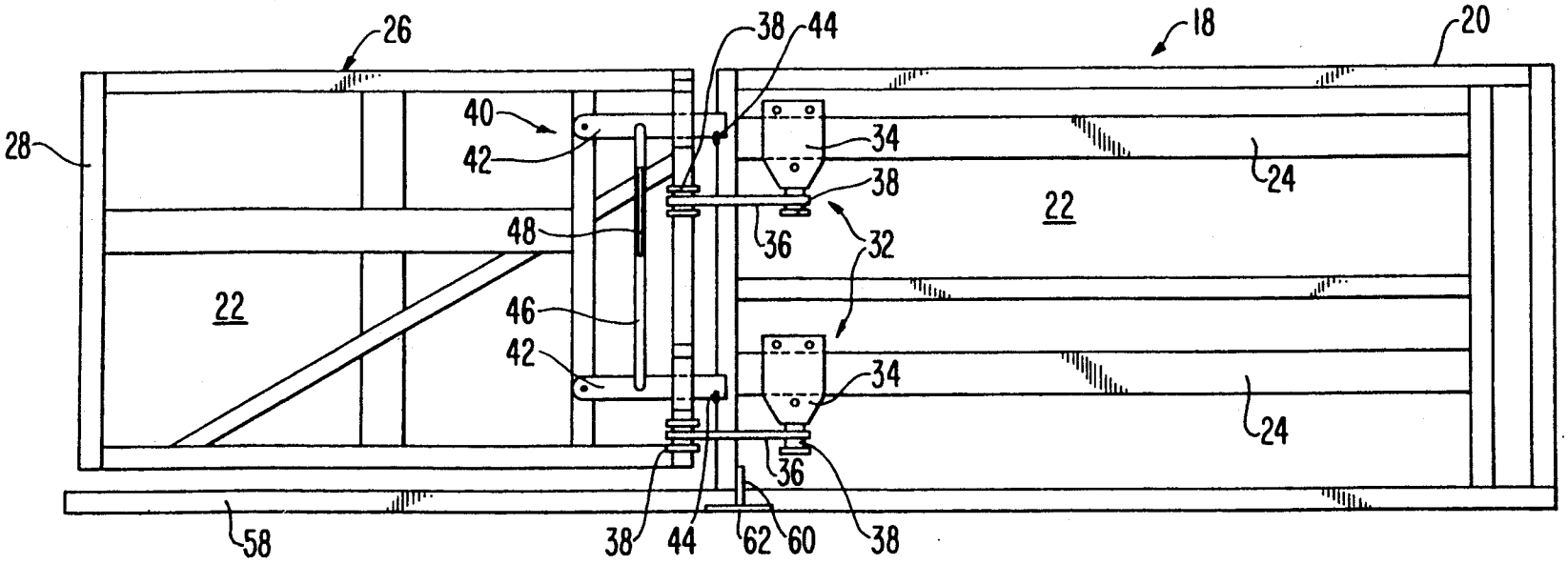
FIG. 2 is a side elevational view of the sliding door and cooperating door panel member in accordance with a preferred embodiment of the invention, as viewed from the outside (the non-ice side) of the rink.

As shown in FIG. 2, door panel member 18 includes a frame 20. The door panel member is faced (on the ice side) with a dasher board 22. In this way, door panel member simply replaces one of the standard dasher board panels 12. The door panel member 18 further includes transverse slide rails 24 which cooperate with the hinge mechanism to permit the sliding action of the door upon release of a latch mechanism, in a manner to be discussed in detail below.

Figure 3:
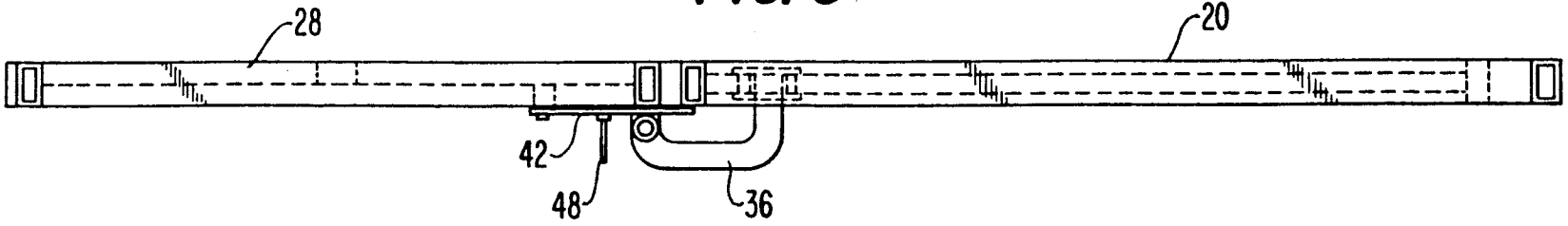
FIG. 3 is a top plan view of the door and door panel shown in FIG. 2.

Door member 26 includes a frame 28 and is faced with a dasher board 22 on the ice side of the door member. In the preferred embodiment illustrated in FIGS. 2 and 3, two hinge mechanisms 32 operatively connect the door member 26 and door panel member 18. Each hinge mechanism 32 includes a slider 34 mounted in sliding engagement with the transverse slide rails 24 of the door panel member 18. Each hinge mechanism further includes a hinge arm 36. Each hinge arm 36 is pivotally connected via pivots 38 at each end thereof between the frame 28 of door member 26 and the slider 34. These pivots can be of any suitable construction, although taper bearings (not shown) are preferably used within each pivot structure to assist in supporting the weight of the door when the door is unlatched.

Latch mechanism 40 preferably includes two latch bars 42, although a single centrally located latch bar could also be used. Each latch bar is pivotally coupled at one end to frame 28 of door member 26. The other end of each latch member cooperates with a latch hook 44 to latch the door closed. A support member 46 having handle 48 extends vertically between the two latch bars 42. When the handle is lifted slightly, the latch bars 42 disengage from latch hooks 44, thus permitting the door to slide along slide rails 24 in a direction parallel to the face of the door panel member.

Figure 4:
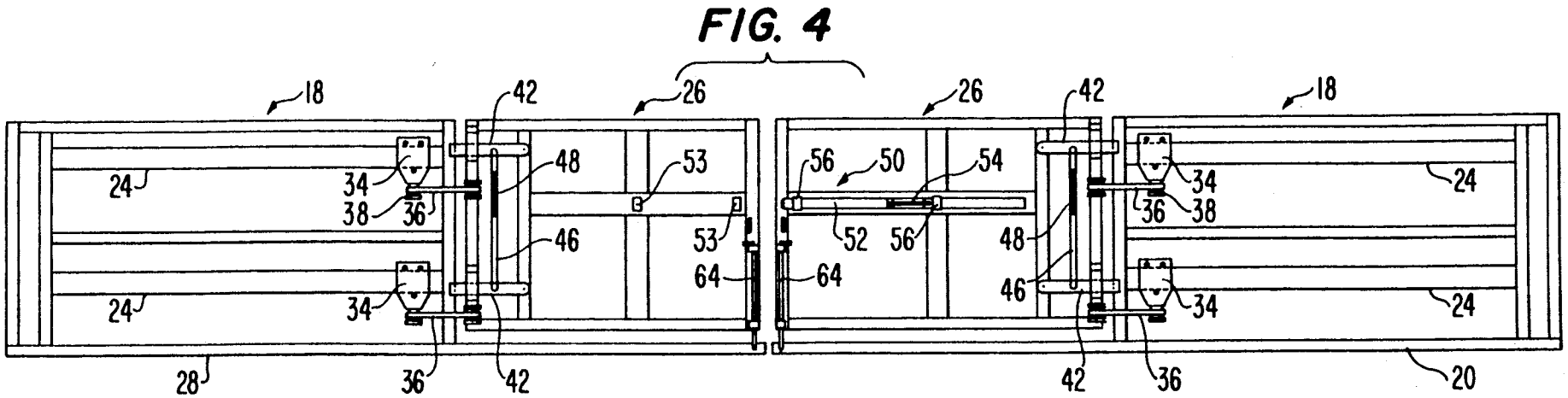
FIG. 4 is a side elevational view of the sliding door and cooperating door panel member in accordance with a second preferred embodiment of the invention which provides clearance for an ice resurfacing machine or other multi-purpose clearance.

It is particularly advantageous that ice resurfacing doors be constructed according to this invention, as shown in FIG. 4. As mentioned above, these doors are typically five feet wide and are used in pairs, so as to form a ten foot side door opening that will permit passage of an ice resurfacing machine.

The doors according to a second preferred embodiment of the invention shown in FIG. 4 are identical to the door shown in FIG. 1, except that a latch mechanism 50 is used in addition to latch mechanism 40. Latch mechanism 50 includes latch bar 52 having a handle 54 which is slidably mounted to door frame 28 of door member 26 via stays 56. The latch bar cooperates with a latch hook 53 disposed on the opposing door to latch the doors together and prevent sagging. When unlatched, both doors can be slid out of the way in the manner described above to permit an ice resurfacing machine (such as that known under the trade name "Zamboni") to enter the ice rink for resurfacing. A floor anchor 64 can be used to anchor the free end of door member 26 firmly in place.

In the preferred embodiments shown in FIGS. 2 and 4, door panel member 18 preferably includes a base frame extension 58 which extends beneath the door member 26. A gusset 60 and base plate 62 are preferably fitted between the lower portion of frame 20 and extension 58 and the ice rink substrate to form a threshold against which ice can be built. Once the frame, gusset and base plate are in place, approximately 1 to 1½ inches of ice is built above the elevation of the concrete perimeter that the dasher board system is mounted upon.

The above is for illustrative purposes only. Modification can be made, particularly with regard to size, shape and arrangement of parts, within the scope of the invention as defined by the appended claims. For example, it is envisioned that the door may pivot in a conventional manner, as well as slide.

What is claimed is:

1. An ice rink, said ice rink comprising:

a plurality of dasher boards panels connected to form the perimeter wall of the ice rink;

at least one door unit located between two dasher board panels, said door unit including a door member, said door member having a hinge mechanism disposed on the outside surface thereof;

a door panel member adjacent said door member, said door panel member having slide mechanism disposed on the outside surface thereof for cooperating with said hinge mechanism; and a first latch means for latching said door member in a closed position, so that when said latch means is unlatched, said door member can slide parallel to said door panel member to permit ingress to or egress from the ice rink.

2. An ice rink as in claim 1, wherein said slide mechanism comprises a pair of parallel transverse slide rails.

3. An ice rink as in claim 2, wherein said hinge mechanism comprises a pair of sliders, each said slider cooperating with one of said transverse slide rails.

4. An ice rink as in claim 3, wherein said hinge mechanism further comprises a pair of latch arms, each said latch arm being pivotably coupled at one end to said corresponding slider and at the other end to said door member.

5. An ice rink as in claim 1, wherein said latch means includes a pair of latch bars pivotably coupled to said door member and a support member extending between each of said latch bars, the free end of each latch bar cooperating with a latch hook formed on said door panel member for latching said door member.

6. An ice rink as in claim 1, further comprising a second door unit disposed adjacent said first door unit so as to form a double opening large enough to permit passage of an ice resurfacing machine.

7. An ice rink as in claim 6, further comprising a second latch means for latching said first door unit to said second door unit.

8. An ice rink as in claim 7, wherein said second latch means includes a sliding latch bar disposed on said first door unit for cooperating with a latch hook disposed on said second door unit.

9. An ice rink as in claim 6, further comprising a pair of floor anchor pins, each anchor pin being slidably mounted on the free end of said corresponding first and second door units.

* * * * *